US006832922B2

(12) United States Patent
Kozono et al.

(10) Patent No.: US 6,832,922 B2
(45) Date of Patent: Dec. 21, 2004

(54) LEVER-TYPE CONNECTOR WITH CORRECTION PORTION FOR CORRECTING DEFORMATIONS IN A CONNECTOR COVER

(75) Inventors: Seiji Kozono, Haibara-gun (JP); Takashi Kimura, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/386,563

(22) Filed: Mar. 13, 2003

(65) Prior Publication Data

US 2003/0181083 A1 Sep. 25, 2003

(30) Foreign Application Priority Data

Mar. 18, 2002 (JP) ..... P2002-073881

(51) Int. Cl.[7] ..... H01R 13/44
(52) U.S. Cl. ..... 439/135; 439/157
(58) Field of Search ..... 439/135, 157, 439/468

(56) References Cited

U.S. PATENT DOCUMENTS 6,045,384 A * 4/2000 Norizuki et al. ..... 439/310
6,354,852 B2 * 3/2002 Noro et al. ..... 439/157
2003/0176090 A1 * 9/2003 Kozono et al. ..... 439/157

FOREIGN PATENT DOCUMENTS

JP 5-55470 U 7/1993

* cited by examiner

*Primary Examiner*—Hae Moon Hyeon
(74) *Attorney, Agent, or Firm*—Sughrue Mion, PLLC

(57) ABSTRACT

A connector with a cover includes a housing in which a linear member is disposed, a cover being attachable to the housing for guiding the liner member, and a correction portion which is provided in the housing. The correction portion corrects a deformation of the cover when the cover is engaged with the housing while the cover is deformed with respect to an original shape.

7 Claims, 9 Drawing Sheets

LEVER-TYPE CONNECTOR WITH CORRECTION PORTION FOR CORRECTING DEFORMATIONS IN A CONNECTOR COVER

BACKGROUND OF THE INVENTION

The present invention relates to, for example, a low insertion force connector, and more particularly to a connector with a cover which, when a deformed cover is engaged with and fitted to a connector housing, allows the cover to be fitted to the connector housing after correcting the deformation which occurred in the cover.

FIGS. 9 to 12 show one form of a related connector (JP-A-5-55470U).

As shown in FIGS. 9 and 10, this combination connector has a pair of holding members 101 and 106 each capable of detachably holding a plurality of connectors 107.

As shown in FIG. 10, each connector 107 has a pair of female terminals 111. In addition, the holding member 101 has connector portions 102 and pairs of male tabs 104, and the holding member 101 also serves as a connector housing. The pairs of male tabs 104 provided projectingly on a printed circuit board 103 are extended and are respectively accommodated in the connector portions 102 juxtaposed in the connector housing.

In addition, a cover 108 is detachably fitted to the one holding member 106 on the wire insertion side thereof. Pressing portions 138 are provided projectingly on this cover 108. The pressing portions 138 provided projectingly on the cover 108 are used to press end portions of the connectors 107 held in the one holding member 106 toward the other holding member 101 side.

In addition, as shown in FIG. 9, a pair of detachably retainable pins 105 are provided projectingly on the one holding member 106 in correspondence with a pair of cam grooves 110 formed in a lever 109. The lever 109 having the cam grooves 110 formed therein is rotatably fitted to upper and lower sides of the other holding member 101. As the lever 109 is rotatively operated in a state in which the pair of pins 105 provided projectingly on the one holding member 106 are respectively retained in the cam grooves 110 formed in the lever 109, the plurality of connectors 107 held in the one holding member 106 and the plurality of connector portions 102 provided in the other holding member 101 are engaged with each other at one time.

With the above related combination connector, however, as shown in FIGS. 11 and 12, since the cover 108 is easily deformable, apprehension has been felt over the occurrence of the trouble that the cover 108 cannot be positively fitted to the one holding member 106 provided on the connector side.

It is therefore an object of the present invention to provide a connector with a cover, which when a deformed cover is engaged with and fitted to a connector housing, allows the cover to be fitted to the connector housing after correcting the deformation which occurred in the cover.

SUMMARY OF THE INVENTION

In order to achieve the above object, according to the present invention, there is provided a connector with a caver comprising:

a housing, in which a linear member is disposed;

a cover, attachable to the housing for guiding the liner member, and a correction portion, provided on the housing, wherein the correction portion corrects a deformation of the cover when the cover is engaged with the housing while the cover is deformed with respect to an original shape.

In the above configuration, when the cover is engaged with the housing, even if a cover which is deformed with respect to an original shape is deformed is engaged with the housing, since the correction portion for correcting the deformation of the cover is provided in the housing, the cover is smoothly fitted to the housing. In addition, since the linear member which is led into the housing is made difficult to jut out toward the outside of the housing by virtue of the correction section, the cover is easily and speedily engaged with and fitted to the housing without being hampered by the linear member. Accordingly, faulty engagement of the cover with the housing is prevented in advance.

Preferably, the correction portion includes a part of a peripheral wall which forms the housing and a reinforcing wall which is provided on the housing so as to form a space between the part of the peripheral wall and the reinforcing wall, and a peripheral wall which forms the cover is inserted into the space so that the deformation of the cover is corrected when the cover is engaged with the housing.

In the above configuration, since the peripheral wall for forming the cover is inserted and fitted between the peripheral wall for forming the housing and the reinforcing wall provided in the housing, the deformation of the cover is corrected reliably.

Preferably, the housing is a transversely elongated housing. The reinforcing wall is a plurality of reinforcing walls, each of the reinforcing wall is provided on an inner side of the peripheral wall of the housing. The ach of the reinforcing wall is extended in the transversely elongated direction of the housing.

In the above configuration, if the housing is formed to be transversely elongated, the cover which is engaged with and fitted to this housing is also formed to be transversely elongated, and the cover becomes easily deformable. If a plurality of reinforcing walls are provided in such a manner as to extend along an inner side in a transversely elongated direction of the peripheral wall for forming the housing, the deformed cover is engaged with and fitted to the housing while being easily and reliably reshaped into a predetermined shape.

Here, it is preferable that, the peripheral wall which forms the housing has a slanted guide face for guiding the peripheral wall of the cover into the space.

In the above configuration, when the cover is engaged with and fitted to the housing, the cover is smoothly engaged with and fitted to the housing.

Here, it is preferable that, a peripheral wall which forms the cover has a slanted guide face for guiding the peripheral wall of the cover into the space.

In the above configuration, when the cover is engaged with and fitted to the housing, the cover is smoothly engaged with and fitted to the housing.

Here, it is preferable that, the reinforcing wall has a slanted guide face for guiding the peripheral wall of the cover into the space.

In the above configuration, when the cover is engaged with and fitted to the housing, the cover is smoothly engaged with and fitted to the housing.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Embodiments of a connector with a cover according to the invention will be explained in detail with reference to the accompanying drawings.

Respective directions of the connector with a cover will be explained based on FIGS. 1 and 2.

Figure 1:
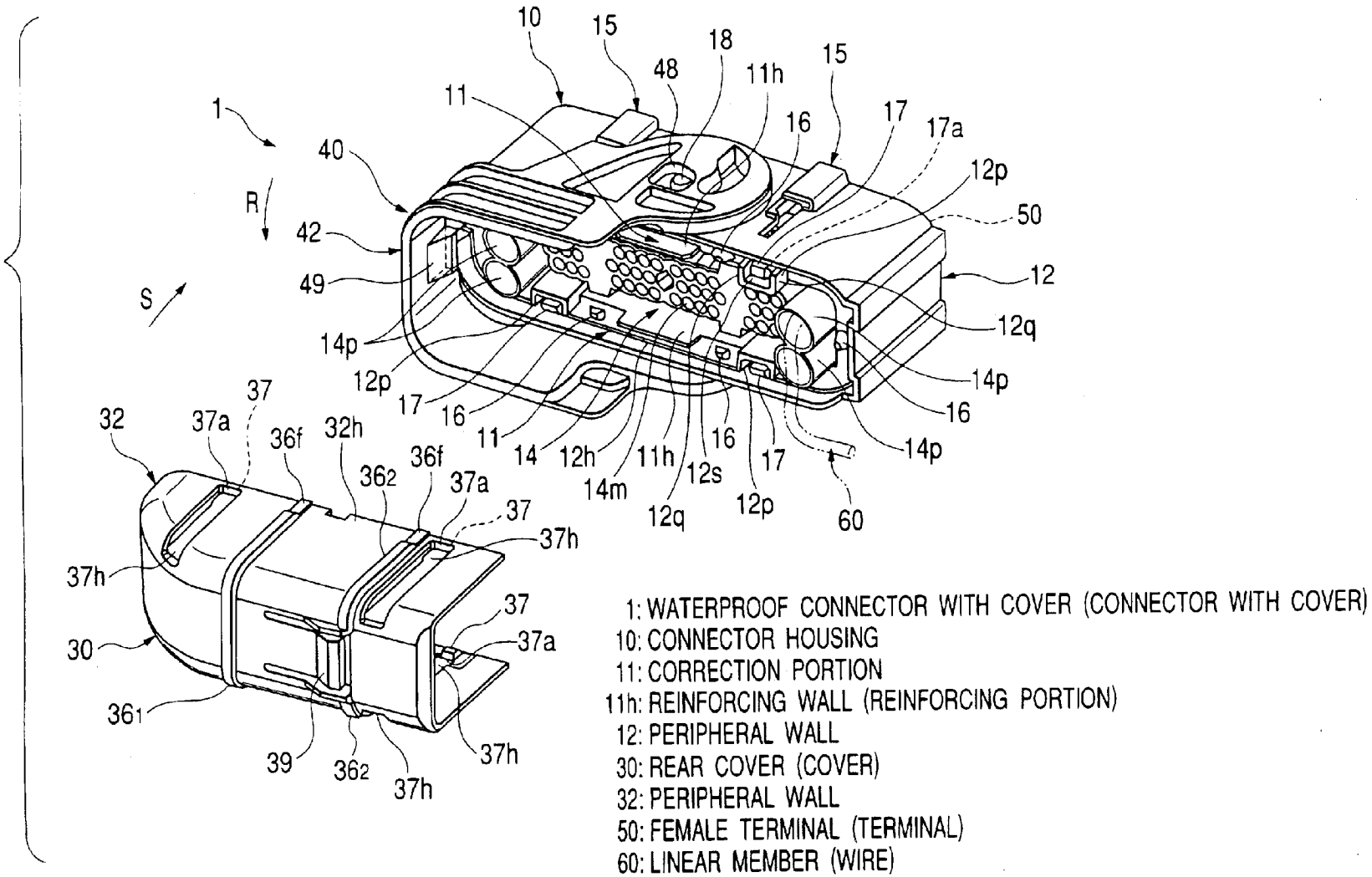
FIG. 1 is an exploded perspective view illustrating an embodiment of a connector with a cover in accordance with the invention.

First, as to the definition of "upper and lower", one surface side of the connector housing 10 on which a shaft portion 18 can be seen in FIG. 1 is defined as an upper side, while the opposite surface side thereof is defined as a lower side. The "upper and lower" directions in the specification means the elevational direction of the connector 1 with a cover disposed horizontally shown in FIGS. 1 and 2.

Figure 2:
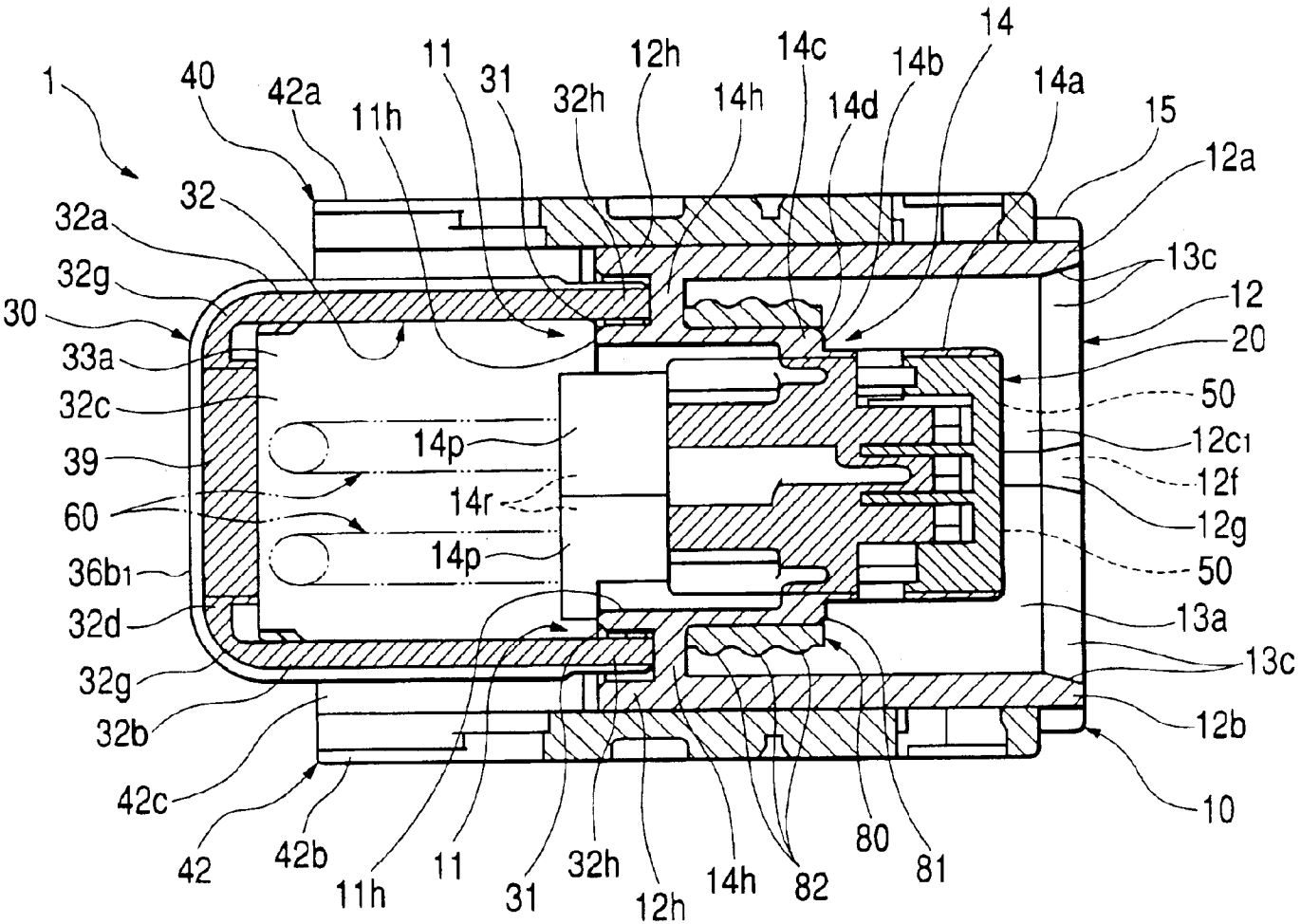
FIG. 2 is a vertical cross-sectional view illustrating the connector with a cover.
Figure 5:
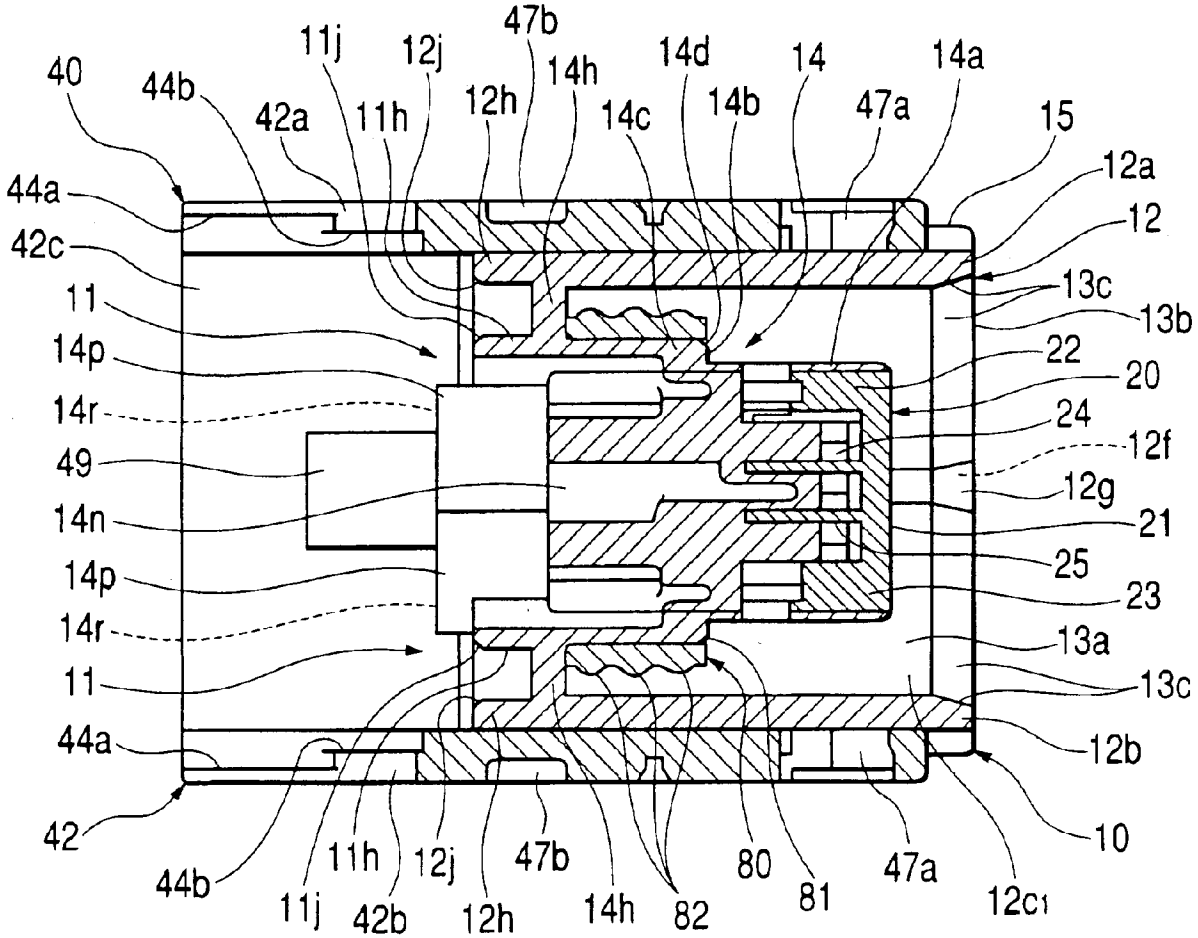
FIG. 5 is a cross-sectional view taken along line A—A and illustrating the interior of the connector housing shown in FIG. 3.

As to the definition of "front and rear", with respect to a peripheral wall 12 forming the connector housing 10, one surface side of the connector housing on which a front holder 20 is attached to the housing main body portion 14 of the connector housing 10 as shown in FIGS. 2 and 5 is defined as a front side, while another surface side of the connector housing on which an electric wire 60 is extracted from the connector housing 10 as shown in FIGS. 1 and 2 is defined as a rear side. Further, one surface side of a peripheral wall 32 forming a cover 30 on which a lock arm 39 is provided is defined as a rear side, while the opposite surface side thereof is defined as a rear side.

A main surface view and a rear surface view relating to the connector will be explained. With respect to a subject connector, the main surface view represents a state where the subject connector is seen from a surface side thereof which is fitted into a corresponding connector, while the rear surface view represents a state where the subject connector is seen from a terminal insertion side thereof, that is, an electric wire extracting side or an electric wire introducing side. The "left and right" directions in the specification means the most long-side width direction of the connector 1 with a cover disposed horizontally.

Figure 8:
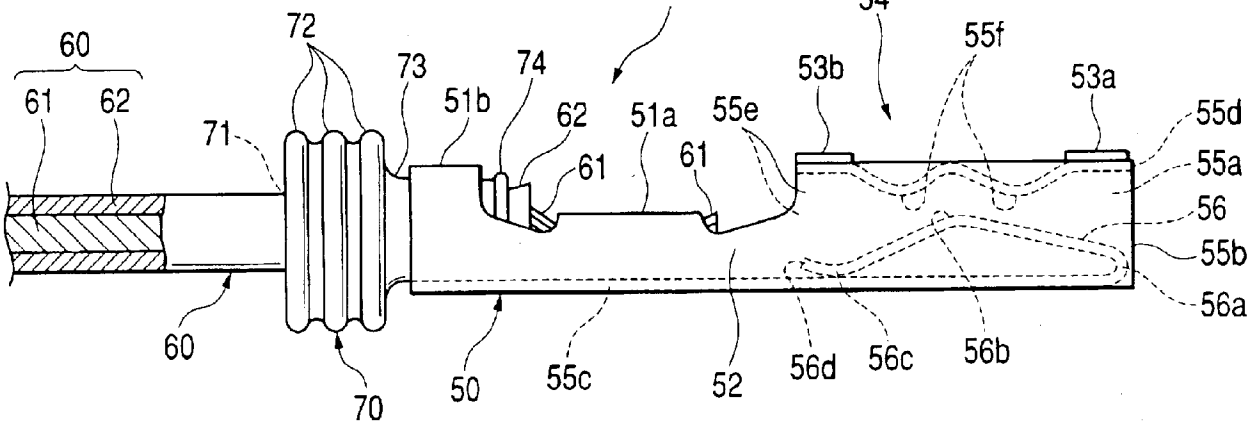
FIG. 8 is an explanatory diagram illustrating a terminal and a waterproof plug attached to a wire.
Figure 9:
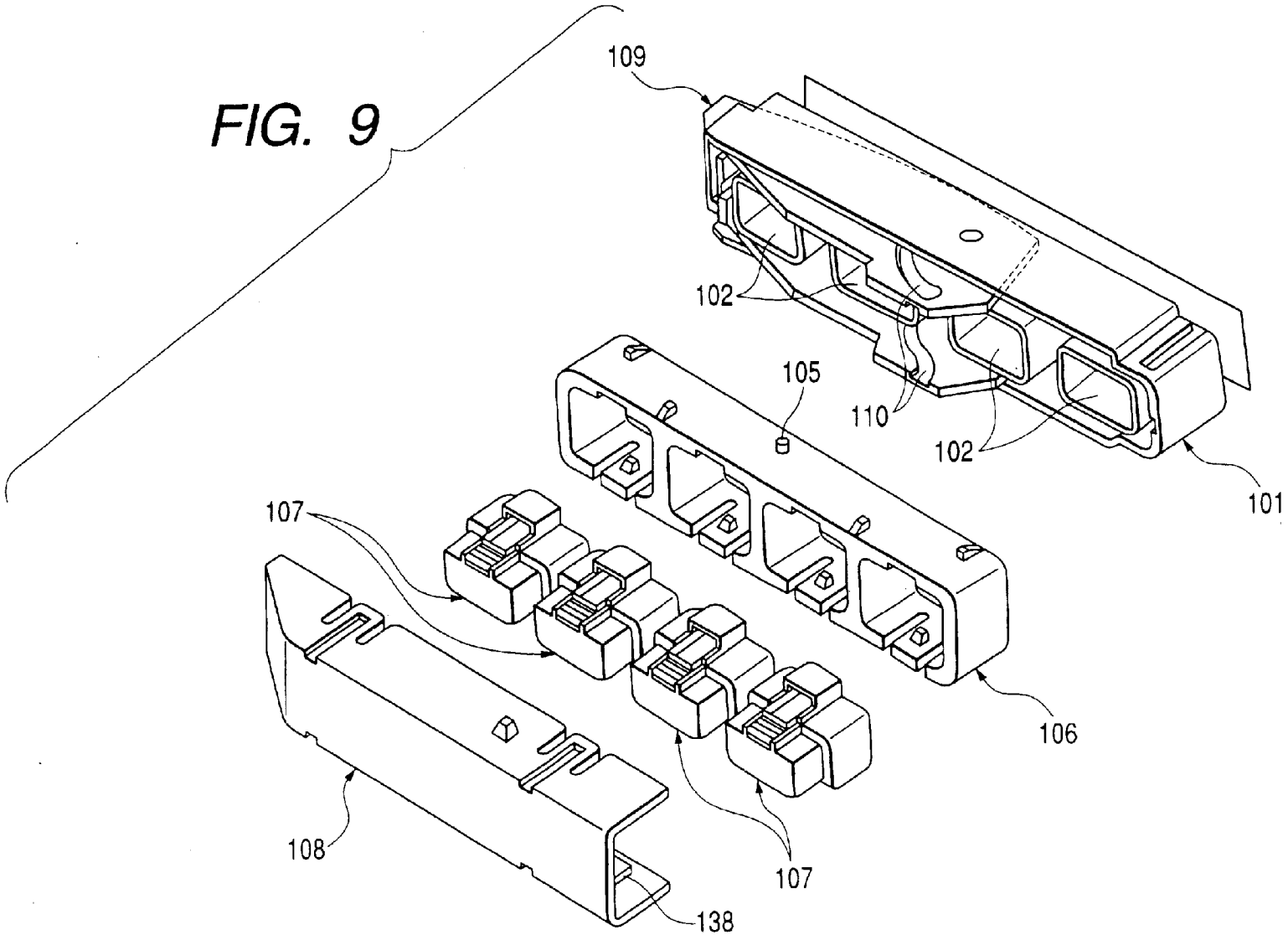
FIG. 9 is an exploded perspective view illustrating one form of a related combination connector.
Figure 10:
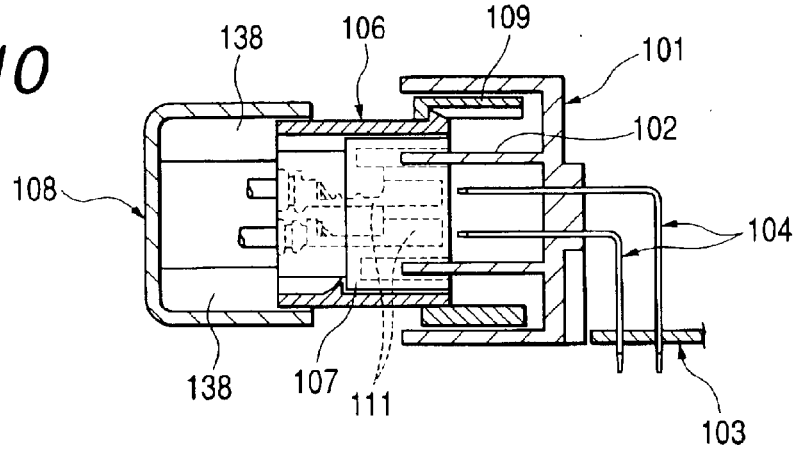
FIG. 10 is a vertical cross-sectional view illustrating the related combination connector.
Figure 11:
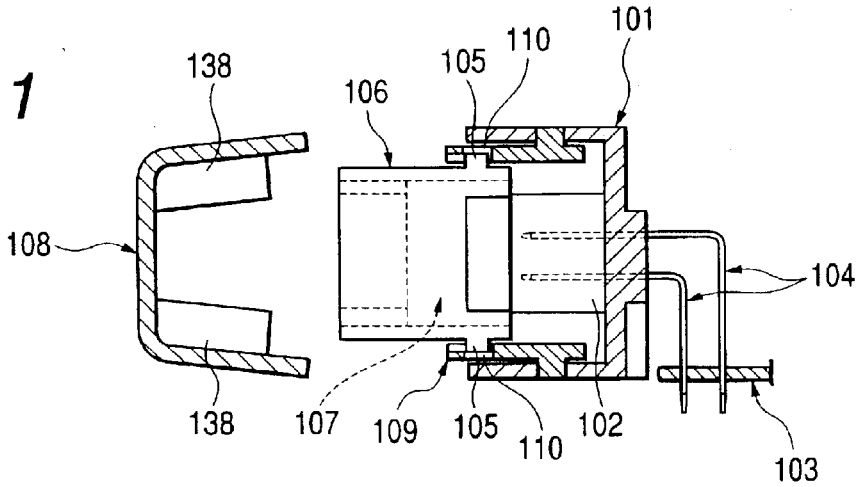
FIG. 11 is an explanatory diagram illustrating the related combination connector.
Figure 12:
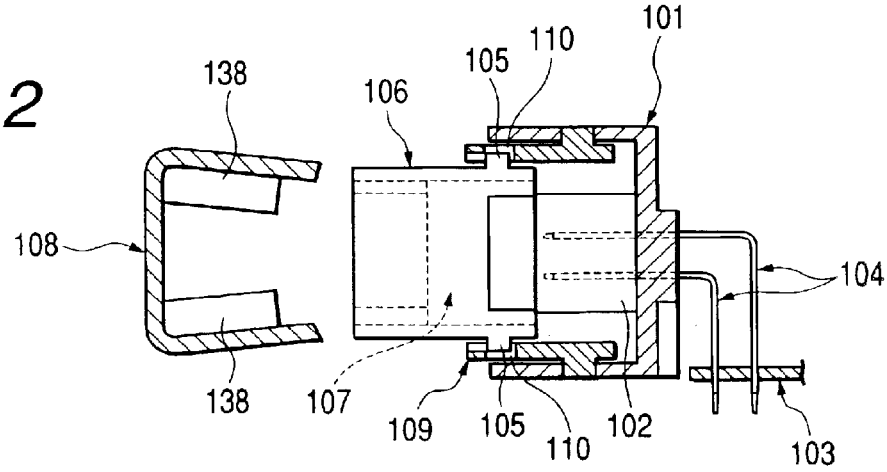
FIG. 12 is an explanatory diagram illustrating the related combination connector.

An arrow S shown in FIG. 1 is illustrated so as to represent both an attachment direction S in which the rear cover 30 is attached to the connector housing 10 and a terminal insertion direction S in which a terminal 50 at which the electric wire 60 and a waterproof plug 70 shown in FIG. 8 are attached is attached within the connector housing 10.

The "upper and lower", "front and rear" and "left and right" directions in the specification are defined merely for convenience and do not necessarily coincide with the directions at the time of actually utilizing the connector with a cover. The connector with a cover according to the invention may be used in an upside-down state or a vertically stood state with respect to the state shown in the drawings, and the connector with a cover according to the invention can be used in any posture.

The connector described in the specification represents a part having a connector housing provided with an electric coupling part such as a terminal in order to perform electric coupling. The connector according to the invention may be one which is provided with a seal member such as a seal, a rubber plug, a waterproof plug, a waterproof packing etc. so as to improve waterproof property in addition to the electric coupling part and a cover such as a rear cover attached to the connector housing, or may be one to which an additive part such as a front holder, a rear holder or a spacer is assembled. Alternatively, the connector according to the invention may be one which is applied to a connector capable of being welded.

Explanation will be made as to the connector housing 10 shown in FIGS. 1 to 3, and 5.

Figure 3:
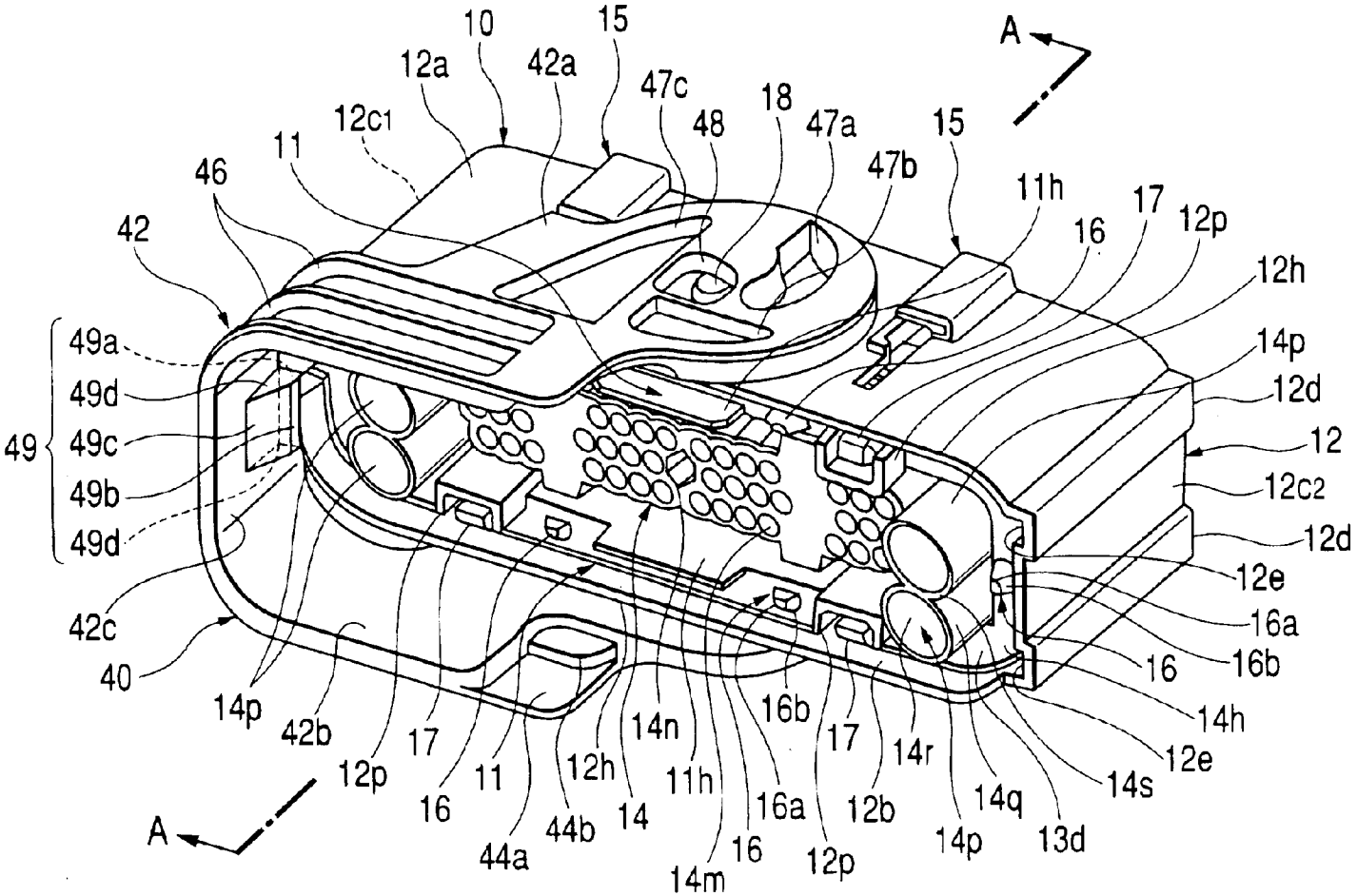
FIG. 3 is a perspective view of a connector housing to which a lever is attached.
Figure 6:
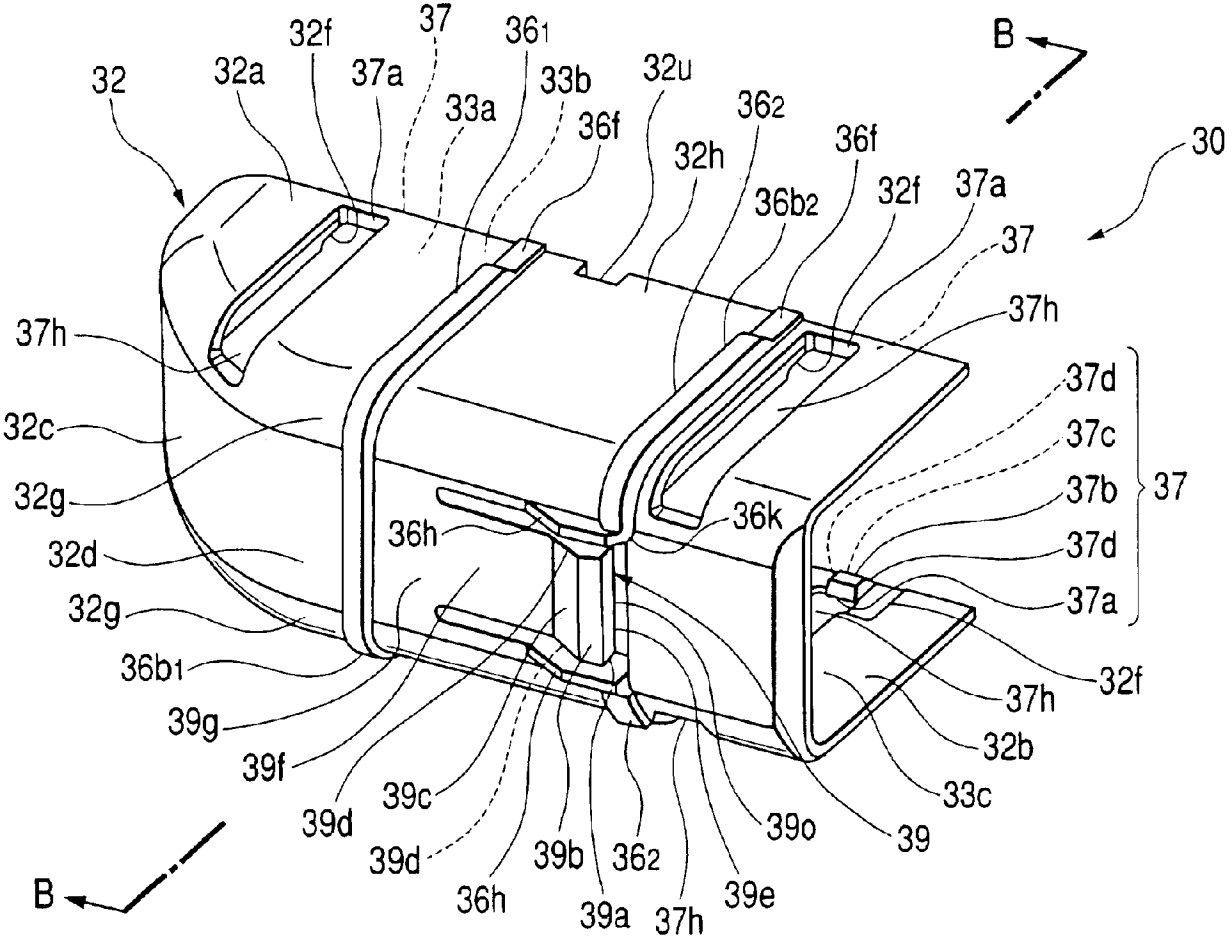
FIG. 6 is a perspective view illustrating the cover.

As shown in FIGS. 3 and 6, the connector housing 10 is provided with a peripheral wall 12, a housing main body portion 14 (FIGS. 1, 3 and 5) formed within the inner space 13*a* (FIG. 5) of the peripheral wall 12 toward the front opening 13*b* (FIG. 5) of the peripheral wall 12 from the rear opening 13*d* (FIG. 3) of the peripheral wall 12, an engaging lock portion 17 (FIGS. 1, 3 and 4) corresponding to the engagement portion 37 (FIGS. 1 and 6) of the rear cover 30, an engagement portion 15 (FIGS. 1 and 3) for surely coupling the connector 1 with a cover shown in FIG. 1 to the corresponding connector (not shown), and a pair of the shaft portions 18 fitted into a pair of shaft hole portions 48 provided at a lever 40 so as to be rotatable, respectively. The peripheral wall 12 may be called a hood portion due to the configuration etc. of the connector housing 10.

As shown in FIGS. 3 and 5, the peripheral wall 12 forming the connector housing 10 is provided with a top wall 12*a*, a bottom wall 12*b* and both side walls $\mathbf{12}c_1$, $\mathbf{12}c_2$ connecting between the top wall 12*a* and the bottom wall 12*b*. The connector housing 10 is formed in an almost rectangular box shape.

A guide projection portion 12*f* is provided at the one side wall $\mathbf{12}c_1$ of the peripheral wall 12 forming the connector housing 10 and a guide groove 12*g* is formed at the inside of the side wall $\mathbf{12}c_1$ so that the corresponding connector (not shown) can be attached to the connector easily and quickly from the front opening 13*b* (FIG. 5) side of the connector 1 with a cover shown in FIGS. 2 and 5.

Similarly, a pair of guide projection portions 12*d* are provided at the other side wall $\mathbf{12}c_2$ of the peripheral wall 12 forming the connector housing 10 and a pair of guide grooves 12*e* are formed at the inside of the other side wall $\mathbf{12}c_2$ as shown in FIG. 3 so that the corresponding connector (not shown) can be attached to the connector easily and quickly from the front opening 13*b* (FIG. 5) side of the connector 1 with a cover shown in FIGS. 2 and 5.

Since the guide projection portions 12*d*, 12*f* and the guide grooves 12*e*, 12*g* are formed at the both side walls $\mathbf{12}c_2$, $\mathbf{12}c_1$ of the peripheral wall 12 forming the connector housing 10, respectively, the connector 1 with a cover shown in FIGS. 1 and 2 and the corresponding connector (not shown) to be coupled therewith are coupled in a predetermined manner without being coupled in an erroneous direction such as an upside-down direction, for example.

Further, a slanted guide surface 13*c* is formed at the peripheral edge portion of the front opening 13*b* of the peripheral wall 12 forming the connector housing 10 so that the corresponding connector (not shown) can be attached to the connector 1 with a cover easily and quickly from the front opening 13*b* (FIG. 5) side of the connector 1 with a cover shown in FIGS. 2 and 5.

Further, as shown in FIG. 3, in a peripheral wall 14*q* forming four terminal insertion portions 14*p* at the connector housing 10, a tapered guide surface 14*s* is provided at the peripheral edge of the rear opening of a terminal insertion hole 14*r* within the peripheral wall 14*q* so that a female terminal 50 (FIG. 8) attached with the electric wire 60 and the waterproof plug 70 can be inserted easily and quickly from the rear side of the connector housing 10 to the inner portion thereof along the terminal insertion direction S shown in FIG. 1.

Further, as shown in FIGS. 2 and 5, the housing main body portion 14 for inserting the female terminal 50 therein and attaching it thereto is formed within the inner space 13*a*, that is, a housing chamber of the peripheral wall 12 forming the connector housing 10 so that the female terminal 50 shown in FIG. 8 can be surely attached to the connector housing 10. The housing main body portion 14 includes a front half portion 14*a* to which the front holder 20 is attached and a rear half portion 14*b* to which a waterproof packing 80 is fitted and attached.

The peripheral wall 12 forming the connector housing 10 and the housing main body portion 14 are coupled integrally to each other through a separation wall 14*h*. The separation wall 14*h* serves to partition the inner space 13*a* (FIG. 5) on the front opening 13*b* side of the connector housing 10 from a rear opening 13*d* side (FIG. 3).

The front holder 20 shown in FIG. 5 will be explained. The front holder 20 includes a front wall 21, an upper wall 22, a lower wall 23, an upper side separation wall 24 and a lower side separation wall 25.

As shown in FIG. 2, the front holder 20 is provisionally engaged and locked with the front half portion 14*a* forming the housing main body portion 14 of the connector housing 10, then the female terminal 50 is inserted from its rear side within the housing chamber of the housing main body portion 14 of the connector housing 10, then the female terminal 50 is provisionally engaged and locked by an engaging lock lance (not shown) provided within the housing main body portion 14, and thereafter the front holder 20 is pushed from its front side toward the rear side thereof and so formally engaged and locked with the front half portion 14*a* forming the housing main body portion 14, whereby the female terminal 50 is surely fixed to the housing main body portion 14. The engaging lock lance is not limited to a lance-shaped one but may be ones with various shapes such as an arm-shaped one.

The rear cover 30 shown in FIGS. 1, 6 and 7 will be explained.

As shown in FIGS. 1 and 6, the rear cover 30 includes a peripheral wall 32 forming the rear cover 30, a plurality of reinforcing ribs $\mathbf{36}_1$, $\mathbf{36}_2$ for reinforcing the peripheral wall 32, an engagement portion 37 (FIGS. 1 and 6) to be surely engaged and locked with the engaging lock portion 17 of the connector housing 10 (FIGS. 1 and 3) thereby to attach the rear cover to the connector housing when the rear cover 30 is attached to the housing shown in FIGS. 1 to 3, and an engaging lock portion 39 (FIGS. 1 and 6) to be surely engaged and locked with the engagement portion 49 (FIGS. 1 and 3) of a lever 40 attached to the connector housing 10 so as to be rotatable. Incidentally, the rear cover may be attached to the connector housing by using a stopper such as a screw etc.

Figure 7:
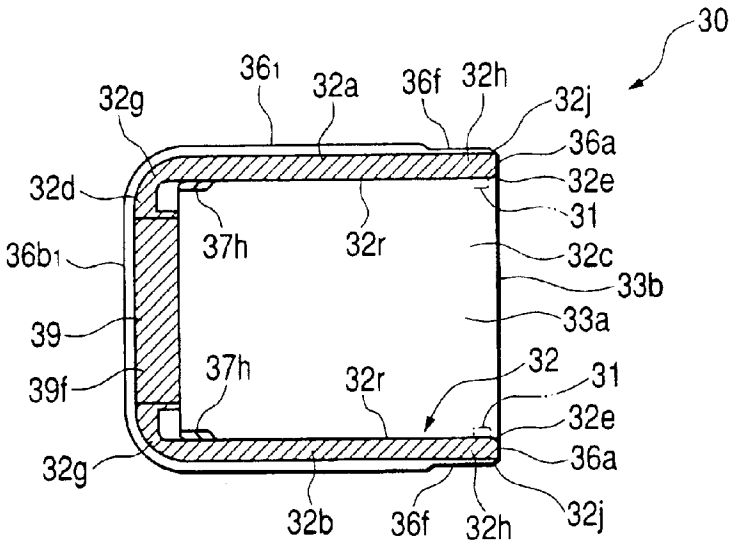
FIG. 7 is a cross-sectional view taken along line B—B and similarly illustrating the cover.

As shown in FIGS. 6 and 7, the peripheral wall 32 forming the rear cover 30 includes a top wall 32*a*, a bottom wall 32*b*, a curved side wall 32*c* for coupling the top wall 32*a* and the bottom wall 32*b*, and a rear portion side wall 32*d*. The curved side wall 32*c* serves to gently bend the linear member extracted from the connector toward the side portion opening 33*c*. The rear portion side wall 32*d* serves to guide the linear member extended along the curved side wall 32*c* to the side portion opening 33*c*. Various kinds of linear members such as the electric wire 60 are housed within an inner side space 33*a* surrounded by the peripheral wall 32.

The front portion opening 33*b* of the rear cover 30 corresponds to the rear opening 13*d* (FIG. 3) of the connector housing 10. As shown in FIG. 1, slanted guide surfaces 32*e*, 32*j* (FIG. 7) are formed at the peripheral edge of the front portion opening 33*b* of the peripheral wall 32 forming the rear cover 30 so that the rear cover 30 can be easily attached to rear portion side of the connector housing 10.

As shown in FIG. 6, the lock arm 39 provided at the rear portion side wall 32*d* of the rear cover 30 includes a root portion 39*g*, a straight portion 39*f* extended from the root portion 39*g*, and an engaging lock projection $\mathbf{39}_0$ formed at the tip end portion 39*e* of the straight portion 39*f*. The longer the straight portion 39*f* forming the lock arm 39 is, the more the flexibility of the lock arm 39 is improved. The engaging lock projection $\mathbf{39}_0$ formed at the lock arm 39 is formed to include an engaging lock surface 39*a*, a slide-contact surface 39*b*, a slanted slide-contact surface 39*c* and a pair of side surfaces 39*d*.

The lever 40 shown in FIGS. 1 to 3 and 5 will be explained.

As shown in FIG. 1, the lever 40 includes a frame portion 42 forming the lever 40, a pair of shaft hole portions 48 for rotatably mounting the lever 40 with respect to the connector housing 10 around the pair of the shaft portions 18 provided at the connector housing 10, and the engagement portion 49 for surely engaging and locking the lever with the engaging lock portion 39 of the rear cover 30.

As shown in FIGS. 3 and 5, the frame portion 42 forming the lever 40 includes a top plate 42*a*, a bottom plate 42*b* and a side plate 42*c* for coupling the top plate 42*a* and the bottom plate 42*b*. As clear from FIGS. 1 and 2, the rear cover 30 is positioned at a space surrounded by the frame portion 42 forming the lever 40.

As seen from FIG. 3, a pair of grooves 46 are provided so as to extend from the top plate 42*a* of the frame portion 42 forming the lever 40 to the bottom plate 42*b* through the side plate 42*c* so that molding deformation etc. is hardly generated at the time of forming the lever 40 based on the injection molding method and so the size accuracy of the lever 40 after molding can be maintained.

Various shapes of recessed portions 47*a*, 47*b*, 47*c* are provided in the vicinity of the peripheral portion of the shaft hole portion 48 provided at the frame portion 42 of the lever 40. Further, as shown in FIGS. 3 and 5, a plurality of step portions 44*a*, 44*b* are provided at each of the top plate 42*a* and the bottom plate 42*b* forming the lever 40.

When the rotation lever 40 is mounted at the connector housing 10, the top plate 42*a* and the bottom plate 42*b* of the frame portion 42 forming the lever 40 shown in FIGS. 3 and 5 are bent along such a direction that the frame portion is opened. Since the pair of the grooves 46 are provided at the frame portion 42 forming the lever 40, the strength of the frame portion 42 forming the lever 40 is maintained while the top plate 42*a* and the bottom plate 42*b* forming the lever 40 are easily deformed elastically along the opening direction.

In a state where the frame portion 42 forming the lever 40 is widened and deformed elastically along the opening direction, when the pair of the shaft portions 18 provided at the connector housing 10 are fitted into the pair of the shaft hole portions 48 provided at the lever 40, respectively, the lever 40 is assembled rotatably with the connector housing 10.

When the lever 40 is rotated toward the rear side of the connector housing 10 along a rotation direction R (FIG. 1) with respect to the connector housing 10 after the rear cover 30 shown in FIGS. 1 and 2 is attached to the connector housing 10, the connector 1 with a cover can be surely coupled with the not-shown corresponding connector with a small force so as to be conductive to each other. Further, the engagement portion 49 of the lever 40 is engaged and locked with the engaging lock portion 39 of the rear cover 30, so that the rear cover 30 is prevented from being inadvertently disengaged from the connector housing 10 and so surely fixed to the connector housing 10. In this manner, the connector 1 with a cover shown in FIGS. 1 and 2 is used as a low insertion force connector with a cover having the rotation lever.

As shown in FIG. 3, the engagement portion 49 provided at the inner side of the side plate 42*c* forming the lever 40 is formed to include an engagement surface 49*a*, a slide-contact surface 49*b*, a slanted slide-contact surface 49*c* and a pair of side surfaces 49*d*.

Terminals etc. such as the female terminal 50 shown in FIG. 8 will be explained.

The female terminal 50 serves to receive therein a male terminal to electrically connect therewith and represents a corresponding terminal of the male terminal. There is such a female terminal 50 which is provided with an elastic contact piece such as a spring which generates a contact load. The female terminal 50 exemplarily shown in the embodiment of the invention is configured in a rectangular box shape corresponding to the male terminal (not shown) to be attached to the corresponding terminal (not shown) and provided with an elastic contact piece therein.

Other than such a female terminal 50 of a rectangular box shape, there are female terminals with an almost rectangular cylindrical shape or a cylindrical shape in corresponding to a male terminal with various shapes such as a tab type, an angular pin type, a circular pin type etc., for example. The various types of the terminals may be provided with engaging lock lances. Terminals of any configurations such as a female terminal and a male terminal can be used as terminals used in the connector with a cover according to the invention.

The female terminal 50 with a predetermined configuration is formed in a manner that a metal plate member is subjected to a stamping process to form a terminal metal member material, and then the terminal metal member material is subjected to a bending process. The female terminal 50 thus formed by being subjected to the respective pressing processes is formed to include an electric wire coupling portion 51 on the rear side at which the electric wire 60 is attached and an electric contact portion 54 on the front side to be coupled with the corresponding male terminal (not shown) so as to be electrically conductive therewith. The electric wire coupling portion 51 and the electric contact portion 54 forming the female terminal 50 are coupled through a coupling portion 52 to each other.

The electric wire coupling portion 51 of the female terminal 50 includes a pair of conductor press-contact pieces 51*a* and a pair of cover press-contact pieces 51*b*. In the electric wires 60 such as a cable etc., a conductor 61 formed by copper system material such as an annealed copper wire is caulked by the conductor press-contact pieces 51*a* provided at the female terminal 50, whereby the female terminal 50 is coupled to the cable so as to be electrically conductive to each other. An insulation cover member 62, which constitutes the cable and is formed by soft resin material, rubber member, or mixed material thereof etc., is caulked by the pair of the cover press-contact pieces 51*b* provided at the rear side of the female terminal 50.

The electric contact portion 54 of the female terminal 50 is configured in an almost rectangular and cylindrical box shape and provided with a terminal housing chamber 55*a* therein. The tab of the not-shown corresponding male terminal is inserted into the terminal housing chamber 55*a* of the female terminal 50.

The electric contact portion 54 of the female terminal 50 will be explained in detail. The electric contact portion 54 of the female terminal 50 includes a base wall 55*c*, another wall 55*d* positioned in opposite to and almost in parallel to the base wall 55*c* and a pair of side walls 55*e* for coupling the both sides of the base wall 55*c* and the both sides of the another wall 55*d*, and is configured in an almost rectangular and cylindrical box shape.

Caulking portions 53*a*, 53*b* are provided so as to be extended from the one side wall 55*e* forming the electric contact portion 54 of the female terminal 50. The caulking portions 53*a*, 53*b* are subjected to the bending process so as to be laid on the another wall 55*d* forming the electric contact portion 54 of the female terminal 50, whereby the terminal housing chamber 55*a* of the female terminal 50 is configured in an almost rectangular box shape.

In this manner, the electric contact portion 54 of the female terminal 50 is formed to include an opening 55*b* in which the tab of the not-shown corresponding male terminal is inserted and the terminal housing chamber 55*a* at which the tab of the not-shown corresponding male terminal is positioned.

The another wall 55*d* positioned in opposite to and almost in parallel to the base wall 55*c* is subjected to the pressing process thereby to be protruded toward the terminal housing chamber 55*a* side, so that a pair of projection portions 55*f* are formed at the another wall 55*d* positioned in opposite to and almost in parallel to the base wall 55*c*. Such the pair of the projection portions 55*f* serve as a pair of contact points 55*f* in order to couple the female terminal 50 with the tab (not shown) of the male terminal so as to be electrically conductive to each other.

The base wall 55*c* of the electric contact portion 54 of the female terminal 50 is turned up toward the inside of the terminal housing chamber 55*a* from the vicinity of the opening 55*b* of the female terminal 50 thereby: to form the elastic contact piece 56. The elastic contact piece 56 is formed in a manner that it is extended while being gently slanted from a turn-up bent portion 56*a* positioned in the vicinity of the opening 55*b* of the female terminal 50, then further extended while being gently slanted in an opposite side through a tip portion 56*b*, and made in contact with the base wall 55*c* at a bent portion 56*c* in the vicinity of the free end 56*d* of the elastic contact piece 56. The tip portion 56*b* provided at the elastic contact piece 56 serves as a contact point for coupling the female terminal 50 with the tab (not shown) of the male terminal so as to be conductive electrically.

The elastic contact piece 56 approaches gradually from the tip portion 56*b* of the elastic contact piece 56 to the base wall 55*c* and abuts against it at the bent portion 56*c*, then the elastic contact piece 56 is slightly bent in a direction separating from the base wall 55*c* thereby to form the free end 56*d* of the elastic contact piece 56. The curved surface formed in this manner is made in contact so at to be slidable with the inner surface of the base wall 55*c* forming the terminal housing chamber 55*a*.

Since the bent portion 56*c* having such a curved surface is provided at the free end 56*d* of the elastic contact piece 56, the base wall 55*c* of the female terminal 50 is hardly damaged by the free end 56*d* of the elastic contact piece 56, and so the free end 56*d* of the elastic contact piece 56 can move smoothly.

The electric contact portion, that is, the main body portion of the tab of the not-shown male terminal is sandwiched by the pair of the contact points 55*f* provided at the another wall 55*d* and the tip portion 56*b*, that is, another contact point 56*b* provided at the elastic contact piece 56, whereby the female terminal 50 and the not-shown male terminal are made in contact to each other so as to be kept in a state of being electrically conductive to each other. Thus, the connector 1 with a cover is coupled to the not-shown corresponding connector so as to be conductive through the female terminal 50 and the not-shown male terminal.

The electric contact portion of the male terminal is sandwiched by three points, that is, the pair of the contact points 55*f* provided at the another wall 55*d* positioned in opposite to and almost in parallel to the base wall 55*c* of the female terminal 50 and the another contact point 56*b* provided at the elastic contact piece 56. Since the female terminal 50 is coupled to the not-shown male terminal in this manner, a sliding resistance at the time of performing a male-female coupling between the female terminal 50 and the not-shown male terminal can be reduced. Thus, a fitting force at the time of performing the male-female coupling of a multi-pole connector, for example, can be at least slightly reduced, and so it is possible to provide a low insertion force connector with a cover which can perform the male-female coupling with at least slightly improved feeling.

The female terminal 50 shown in FIG. 8 is illustrated as an embodiment and a terminal with any configuration can be used as a female terminal used in the connector with a cover according to the invention. For example, a female terminal to be fitted into the connector housing may be one which is provided with an elastic contact piece having two contact points at the base wall 55*c* forming the electric contact portion 54 of the female terminal and a contact point at the another wall 55*d*. Alternatively, a female terminal may be one, so called, a two part terminal which is configured in a manner that an elastic contact piece as another part is assembled at the terminal housing chamber 55*a* of the female terminal 50.

There are copper system material such as bronze, copper alloy etc. and aluminum alloy, for example, as the material of the terminals etc. such as the female terminal 50 and the male terminal. Any kinds of material can be used as the material of the terminals etc. such as the female terminal 50 and the male terminal used in the invention so long as the material is metal material having conductive function or conductive material capable of passing electric signal well.

When the terminals etc. are applied to a waterproof connector, the material may be subjected to a surface protection process such as a plating process in order to improve the corrosion resistivity of the terminal etc., for example. The surface protection process for the terminal etc. is preferably omitted in view of productivity and cost reduction so long as the connector is used in a normal environment and can maintain its efficiency sufficiently.

The electric wire 60 such as a cable shown in FIGS. 1, 2 and 8 will be explained.

An electric wire in this specification is a general name of ones such as a conductor protected by an insulation cover member, enamel material etc., a conductor in a state of not being covered by any means. Explanation will be made as to the cable simply. A cable is also called as a core wire and is formed by a single conductor protected by an insulation cover member, enamel material etc. or a plurality of conductors protected by an insulation cover member, enamel material etc.

A so-called braid electric wire or braid wire such as a wire harness includes electric wires 60 (FIG. 8), so-called cables, each having a conductor 61 and an insulation cover member 62, a tape for bundling the plural cables, a connector and a grommet etc. When the braid electric wire or braid wire is attached to an automobile etc., it is used by being bent at its necessary portion.

To this end, the material of the conductor 61 has preferably not only good conductivity but also flexibility capable of withstanding repetition of bending operation. As a metal wire formed by such material, there is a copper system electric wire such as an annealed copper wire. The cable is formed in a manner that plural conductors are bundled and twisted suitably to provide a core wire with excellent intensity. Further, a conductor covered by enamel material may be used as an electric wire such as a cable in order to improve insulation property of the surface of the conductor formed by a copper wire, a metal wire etc. while maintaining the thin size thereof.

As the material of the insulation cover member 62 constituting the electric wire 60 such as a cable, there is soft resin, rubber, or mixture thereof, for example. The insulation cover member 62 for protecting the conductor 61 is also preferably formed by insulation material having such a nature of capable of withstanding repetition of bending operation and so desirably formed by elastic insulation material, for example. As such material, there is thermoplastic resin material such as polyvinyl chloride polymer, polyethylene polymer or soft resin material, rubber material or mixture thereof, for example. Further, such material may be insulation material added with various kinds of filler as the need arises.

When the conductor such as a copper wire is passed through the extruded hole of a die at the time of subjecting such insulation cover material to an extrusion molding process, the insulation cover member 62 and the conductor 61 are combined to constitute the electric wire 60 such as a cable.

As shown in FIG. 8, the electric wire 60 is attached to the electric wire coupling portion 51 of the female terminal 50, and the waterproof plug 70 made of silicon rubber is attached together with the electric wire 60 to the rear portion side of the female terminal 50 by caulking the cover press-contact pieces 51*b* of the female terminal 50.

The waterproof plug 70 includes an insertion portion 71 through which the electric wire 60 is drawn with pressure and passed, a caulking portion 73 corresponding to the cover press-contact pieces 51*b* of the female terminal 50, a small diameter end portion 74 which is positioned on the front side of the caulking portion 73 and has an outer peripheral diameter smaller than that of a plurality of lip portions 72, and the three lip portions 72 (FIG. 8) which are adhered to the inner wall surface of the terminal insertion hole 14*r* (FIG. 3) of the terminal insertion portion 14*p* (FIGS. 1 and 3) provided at the connector housing 10.

The connecter 1 with a cover shown in FIGS. 1 and 2 is provided with the connector housing 10 at which the large female terminal 50 and small another female terminal (not shown) are attached, the electric wire 60 to be introduced within the connector housing 10, and the rear cover 30 for guiding the electric wire 60 therein and extracting it therethrough. A linear member such as an optical cable (not shown), a fluid passing tube (not shown) for passing window washer liquid etc. may be attached to the connector housing and such a linear member may be extracted from the rear cover. A correction portion 11, for correcting and absorbing the deformation of the rear cover 30 at the time of fitting and attaching the rear cover 30 deformed from a predetermined configuration to the connector housing 10, is provided at the connector housing 10.

At the time of fitting and attaching the rear cover 30 to the connector housing 10, even when the rear cover 30 deformed from the predetermined configuration is fitted into and attached to the connector housing 10, since the correction portion 11 for correcting and absorbing the deformation of the rear cover 30 is provided at the connector housing 10, the rear cover 30 can be smoothly attached to the connector housing 10.

Further, a linear member such as the electric wire 60 to be introduced into the connector housing 10 hardly sticks out toward the outside of the connector housing 10 due to the presence of the correction portion 11. Thus, the rear cover 30 can be easily and quickly fitted into and attached to the connector housing 10 without being obstructed by the linear member such as the electric wire 60. Therefore, the poor coupling of the rear cover 30 to the connector housing 10 can be prevented from occurring.

As shown in FIGS. 1 to 3 and 5, the correction portion 11 provided at the connector housing 10 is provided with the peripheral wall 12 forming the connector housing 10 and a reinforcing walls 11*h* extended to the rear side from the separation wall 14*h* (FIGS. 3 and 5) within the connector housing 10. The end edge portion 32*h* of the peripheral wall 32 forming the rear cover 30 is fitting into the position between the reinforcing wall 11*h* and the end edge portion 12*h* of the peripheral wall 12 forming the connector housing 10 shown in FIGS. 1 and 2, whereby the deformation of the rear cover 30 is corrected.

In this manner, since the end edge portion 32*h* of the peripheral wall 32 forming the rear cover 30 is fitting into attached to the position between the reinforcing wall 11*h* provided within the connector housing 10 and the end edge portion 12*h* of the peripheral wall 12 forming the connector housing 10, the deformation of the rear cover 30 can be surely corrected. The reinforcing walls 11*h* serve as restriction guide walls for correcting, toward the outside of the rear cover 30, the peripheral wall 32 of the rear cover 30 largely deformed toward the inside.

As shown in FIGS. 1 and 3, the connector housing 10 is formed to be transversely elongated, and the pair of reinforcing walls 11*h* extend along the inner side in the transversely elongated direction, i.e., the left-and-right widthwise direction, of the peripheral wall 12 for forming the connector housing 10.

If the connector housing 10 is formed to be transversely elongated, the rear cover 30 which is engaged with and fitted to this connector housing 10 is also formed to be transversely elongated, so that the rear cover 30 is made deformable. As shown in FIGS. 1 and 6, since the rear cover 30 is formed as having the front opening 33*b* (FIG. 6) and the side opening 33*c* (FIG. 6), the rear cover 30 is made such that its mechanical strength is difficult to improve.

However, if the pair of reinforcing walls 11*h* are provided in such a manner as to extend along the inner side in the transversely elongated direction of the peripheral wall 12 for forming the connector housing 10, the deformed rear cover 30 having a transversely elongated shape can be engaged with and fitted to the connector housing 10 while being easily and reliably reshaped into a predetermined shape.

In addition, to allow the rear cover 30 shown in FIG. 1 to be easily engaged with and fitted to the connector housing 10, as shown in FIG. 5, a slanted guide surface 11*j* for facilitating the insertion of each end portion 32*h* of the rear cover 30 into the correction section 11 is provided at a distal end of each reinforcing wall 11*h*.

Figure 4:
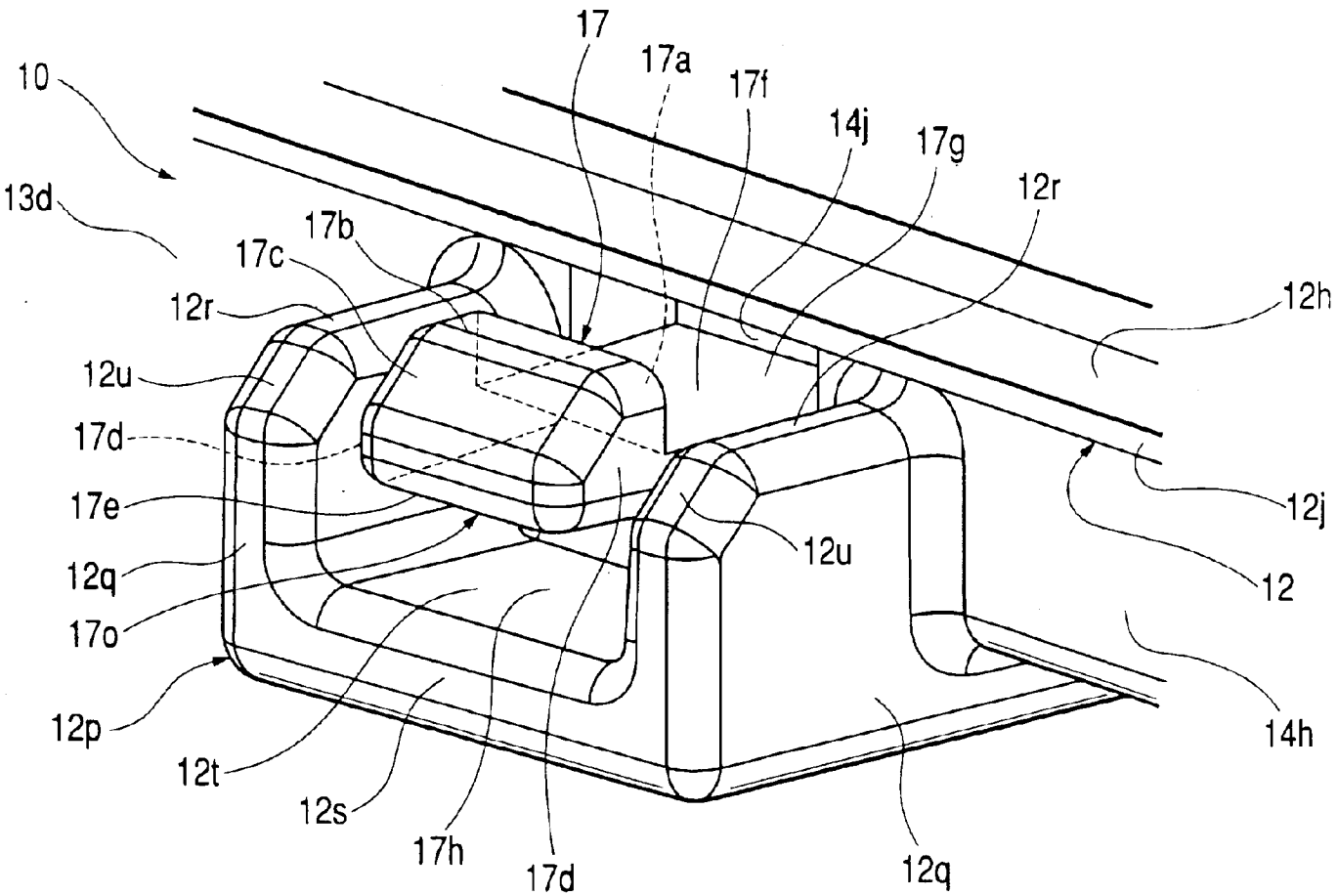
FIG. 4 is an enlarged perspective view illustrating a retaining portion and a protective portion provided on the connector housing.

Similarly, to allow the rear cover 30 shown in FIG. 1 to be easily engaged with and fitted to the connector housing 10, as shown in FIGS. 4 and 5, a slanted guide surface 12*j* is provided at each end portion 12*h* on the rear side of the peripheral wall 12 for forming the connector housing 10.

In addition, similarly, to allow the rear cover 30 shown in FIG. 1 to be easily engaged with and fitted to the connector housing 10, as shown in FIG. 4, a slanted guide surface 12*u* is provided at each protective side wall 12*q* for forming a protective portion 12*p*.

If such slanted guide surfaces 11*j*, 12*j*, and 12*u* are respectively provided at the distal end of each reinforcing wall 11*h* provided in the connector housing 10, each end portion 12*h* on the rear side of the peripheral wall 12 for forming the connector housing 10, and each protective side wall 12*q* for forming the protective portion 12*p* of the connector housing 10, the rear cover 30 is smoothly engaged with and fitted to the connector housing 10 when the rear cover 30 shown in FIG. 1 is engaged with and fitted to the connector housing 10.

In addition, as shown in FIGS. 1 and 2, when the rear cover 30 is engaged with and fitted to the connector housing 10, to allow the end portion 323*h* on the front opening 33*b* side (FIGS. 6 and 7) of the rear cover 30 to be easily inserted into the correction section 11 provided on the rear opening 13*d* side (FIG. 3) of the connector housing 10, the slanted guide surfaces 32*e* and 32*j* are formed on each end portion 32*h* at the front opening 33*b* of the peripheral wall 32 for forming the rear cover 30, as shown in FIG. 7.

If such slanted guide surfaces 32*e* and 32*j* are provided at the end portions 32*h* on the front opening 33*b* side of the peripheral wall 32 for forming the rear cover 30, when the rear cover 30 shown in FIG. 1 is engaged with and fitted to the connector housing 10, the rear cover 30 is smoothly engaged with and fitted to the connector housing 10.

In correspondence with the correction section 11 of the connector housing 10 shown in FIGS. 1 to 3 and 5, a pair of holding portions 31 which are made to abut against this correction section 11 may be provided on the rear cover 30, as shown in FIGS. 2 and 7.

It is possible to use an arrangement in which, as shown in FIG. 7, the holding portions 31 are each provided on the inner side of the end portion 32*h* of the peripheral wall 32 on the front opening 33*b* side of the peripheral wall 32 for forming the rear cover 30. These holding portions 31 are formed as projections 31 which are made to reliably abut against the reinforcing walls 11*h* of the connector housing 10 shown in FIGS. 2 and 5 with their contact areas reduced. The holding portions 31 are formed on the rear cover 30 as transversely elongated ridges in correspondence with the transversely elongated reinforcing walls 11*h* provided in the connector housing 10.

If the holding portions 31 formed as the projections 31 or ridges are provided on the rear cover 30, it can be expected that when the rear cover 30 is engaged with and fitted to the connector housing 10, even if the rear cover 30 which is deformed with respect to a predetermined shape is engaged with and fitted to the connector housing 10, the rear cover 30 is reliably fitted to the connector housing 10 while the rear cover 30 is reshaped into a more predetermined shape with respect to the connector housing 10.

As the projections 31 (FIG. 7) each provided on the inner side of the end portion 32*h* of the peripheral wall 12 for forming the rear cover 30 are made to abut against the reinforcing walls 11*h* of the connector housing 10 shown in FIG. 5, it can be expected that the deformation of the rear cover 30 is corrected more reliably, as shown in FIG. 2. It should be noted that it is also possible to use an arrangement in which such holding portions 31 are not provided on the rear cover 30 and are omitted.

In addition, an end face 36*a* (FIG. 7) on the front opening 33*b* side of the peripheral wall 32 for forming the rear cover 30 is made to abut against a rear side surface of the partition wall 14*h* (FIGS. 4 and 5) of the connector housing 10, thereby stopping the pressing of the rear cover 30 against the connector housing 10, as shown in FIG. 2.

In addition, to facilitate the engagement and fitting of the rear cover 30 shown in FIG. 1 with and to the connector housing 10, as shown in FIGS. 1, 6, and 7, the plurality of ribs $\mathbf{36}_1$ and $\mathbf{36}_2$ are formed as thin-thickness portions 36*f* at the end portions 32*h* of the peripheral wall 32 for forming the rear cover 30.

A reference numeral 16 shown in FIGS. 1 and 3 depicts an engaging lock portion 16 extended from the main body of the waterproof packing 80 shown in FIG. 5, and the waterproof packing 80 can be surely attached to the connector housing 10 due to the provision of the engaging lock portion 16. As shown in FIG. 3, the engaging lock portion 16 provided at the waterproof packing includes a conical mount portion 16*b*, which is almost divided into two parts and provided at a tip end portion 16*a*, for preventing the waterproof packing from coming out.

As shown in FIG. 6, an almost rectangular-shaped notched portion 32*u* is provided at the end edge on the front portion opening 33*b* side of the top wall 32*a* forming the rear cover 30. Although such a notched portion 32*u* is formed in correspondence with a rib (not shown) protrusively provided at the connector housing, such a notched portion 32*u* and a rib (not shown) may be omitted.

As shown in FIG. 4, the lock arm 17 provided at the rear opening 13*d* (FIG. 3) of the connector housing 10 shown in FIGS. 1 and 3 includes a root portion 17*g* provided at the separation wall 14*h*, a straight portion 17*f* extended from the root portion 17*g*, and an engaging lock projection $\mathbf{17}_0$ formed at the tip end portion 17*e* of the straight portion 17*f*.

The longer the straight portion 17*f* forming the lock arm 17 is, the more the flexibility of the lock arm 17 is improved. The engaging lock projection $\mathbf{17}_0$ formed at the lock arm 17 is formed to include an engaging lock surface 17*a*, a slide-contact surface 17*b*, a slanted slide-contact surface 17*c* and a pair of side surfaces 17*d*.

In the case of forming the connector housing 10 having the lock arm 17 provided with the engaging lock surface 17*a* at the engaging lock projection $\mathbf{17}_0$ based on the injection molding method, a through hole 14*j* is provided at the separation wall 14*h* in the vicinity of the periphery of the root portion 17*g* of the lock arm 17 due to the configuration of the injection molding die.

The engagement projection 37 provided at the inside of the end edge portion 32*h* of the peripheral wall 32 on the front portion opening 33*b* side of the peripheral wall 32 forming the rear cover 30 as shown in FIG. 6 includes an engagement surface 37*a*, a slide contact surface 37*b*, a slanted slide-contact surface 37*c* and a pair of side surfaces 37*d*.

The peripheral wall 32 forming the rear cover 30 in the vicinity of the periphery of the engagement projection 37 is formed as the thin-thickness portion 32*f* as shown in FIG. 6 in order to improve the flexibility of the engagement portion 37 of the rear cover 30 at the time of engaging and locking the engaging lock portion 17 provided at the connector housing 10 shown in FIG. 1 with the engagement portion 37 provided at the rear cover 30. The thin-thickness portion 32*f* provided at the end edge portion 32*h* of the peripheral wall 32 forming the rear cover 30 serves as a guide portion in correspondence with the protection portions 12*p* provided within the rear opening 13*d* (FIGS. 3 and 4) of the connector housing 10 shown in FIGS. 1, 3 and 4.

In the process where the plurality of the upper and lower lock arms 17 provided at the connector housing 10 shown in FIG. 3 are engaged and locked with the plurality of the upper and lower engagement projections 37 provided at the rear cover 30 shown in FIGS. 1 and 6, each of the plurality of the upper and lower lock arms 17 (FIGS. 1, 3 and 4) formed at the connector housing 1.0 is bent toward the inside of the connector housing 10 and also, as to the peripheral wall 32 forming the rear cover 30, the top wall 32*a* and the bottom wall 32*b* shown in FIGS. 6 and 7 are slightly bent along such an opening direction that both the top and bottom walls separate to each other.

Since a pair of thin-thickness bent portions 32*g* are provided at the peripheral wall 32 forming the rear cover 30 as shown in FIG. 7, the top wall 32*a* and the bottom wall 32*b* forming the rear cover 30 are bent easily along the opening direction and so elastically deformed.

Further, as shown in FIGS. 6 and 7, since the plurality of reinforcing ribs $\mathbf{36}_1$, $\mathbf{36}_2$ are provided at the outside of the peripheral wall 32 forming the rear cover 30, the mechanical intensity of the rear cover 30 is improved.

As shown in FIGS. 6 and 7, the main body $\mathbf{36}b_1$ of the reinforcing rib $\mathbf{36}_1$ is extended on the top wall 32*a* forming the rear cover 30 from the front portion opening 33*b* of the rear cover 30, then further extended on the rear portion side wall 32*d* through the thin-thickness bent portion 32*g* on the upper side and furthermore extended on the bottom wall 32*b* through the thin-thickness bent portion 32*g* on the lower side and continued to the front portion opening 33*b* of the rear cover 30. In this manner, the reinforcing rib $\mathbf{36}_1$ provided at the rear cover 30 is formed as an almost annular-shaped reinforcing rib $\mathbf{36}_1$.

As shown in FIG. 6, the main body 36$b_2$ of the other reinforcing rib 36$_2$ is extended on the top wall 32*a* forming the rear cover 30 from the front portion opening 33*b* of the rear cover 30, then further extended on the rear portion side wall 32*d* through the thin-thickness bent portion 32*g* and further extended through a turn-up bent portion 36*k* which is bent almost at a right angle thereby to be formed as a projection portion 36*h* for guiding the engagement projection 49 (FIG. 1) provided at the lever 40.

As shown in FIG. 1, the engaging lock portions 17 are formed on the connector housing 10, and the engagement portions 37 are formed on the rear cover 30 in correspondence with these engaging lock portions 17. When the rear cover 30 is engaged with and fitted to the connector housing 10, as shown in FIG. 2, the correction section 11 of the connector housing 10 and the end portions 32*h* of the rear cover 30 are engaged with each other, and the engagement portions 37 of the rear cover 30 shown in FIG. 6 are retained by the engaging lock portions 17 of the connector housing 10 shown in FIGS. 3 and 4, thereby fixing the rear cover 30 to the connector housing 10.

As shown in FIG. 2, since the correction section 11 provided in the connector housing 10 and the end portions 32*h* of the rear cover 30 are engaged with each other, and the engagement portions 37 (FIGS. 1 and 6) formed on the rear cover 30 are retained by the engaging lock portions 17 (FIGS. 1, 3, and 4) formed on the connector housing 10, the rear cover 30 is smoothly and reliably fixed to the connector housing 10.

The connector housing 10 is provided with the engaging lock portion 17 as shown in FIGS. 1 and 2, and the rear cover 30 is provided with the engagement portion 37 in correspondence with the engaging lock portion 17 as shown in FIG. 1. The engaging lock portion 17 provided at the connector housing 10 is engaged and locked with the engagement portion 37 provided at the rear cover 30, whereby the rear cover 30 is attached to the connector housing 10. The protection portions 12*p* for preventing the excessive deformation of the engaging lock portion 17 shown in FIGS. 1, 3 and 4 when the rear cover 30 is attached to the connector housing 10 are provided at the connector housing 10.

The engaging lock portion 17 provided at the lower side of the connector housing 10 and the protection portion 12*p* provided at the periphery of the engaging lock portion 17 shown in FIGS. 1 and 3 are in an upside down relation with respect to the engaging lock portion 17 and the protection portion 12*p* shown in FIG. 4. The engagement portion 37 provided at the top wall 32*b* (FIG. 6) of the rear cover 30 shown in FIGS. 1 and 6 and the engagement portion 37 provided at the bottom wall 32*a* (FIG. 6) of the rear cover 30 are illustrated in an upside down relation to each other, but each of these portions 37 has the same configuration.

Since the protection portions 12*p* for preventing the excessive deformation of the engaging lock portion 17 of the connector housing 10 are provided at the connector housing 10, when the engaging lock portion 17 of the connector housing 10 is engaged and locked with the engagement portion 37 of the rear cover 30 thereby to attach the rear cover 30 to the connector housing 10, the engaging lock portion 17 of the connector housing 10 is protected by the protection portions 12*p* provided at the connector housing 10.

Thus, such a problem is prevented from occurring that when the rear cover 30 is attached to the connector housing 10, an excessive force is applied to the engaging lock portion 17 of the connector housing 10 and so the engaging lock portion 17 of the connector housing 10 is deformed excessively.

As shown in FIGS. 1, 3 and 4, the engaging lock portion 17 provided at the connector housing 10 is formed so as to include the lock arm 17. The protection portions 12*p* provided at the connector housing 10 are formed so as to include protection walls 12*p* respectively.

Further, as shown in FIG. 4, the protection walls 12*p* is formed to include protection base wall 12*s* and a pair of protection side walls 12*q* respectively. The protection wall 12*p* is formed in a manner that the protection base wall 12*s* and the pair of the protection side walls 12*q* are combined so as to be integrated thereby to form the single protection wall 12*p*. For example, the protection base wall 12*s* and the pair of the protection side walls 12*q* may be separated from one another and the separated ones may be used as the protection portion 12*p*. As shown in FIGS. 1, 3 and 4, the protection walls 12*p* are positioned in the vicinity of the lock arm 17.

Since the protection walls 12*p* respectively serving as the protection portions 12*p* are positioned in the vicinity of the lock arm 17 serving as the engaging lock portion 17, the lock arm 17 can be surely protected by the protection walls 12*p*. Thus, such a problem is prevented from occurring that when the rear cover 30 is attached to the connector housing 10, an excessive force is applied to the lock arm 17 of the connector housing 10 and so the lock arm 17 of the connector housing 10 is deformed excessively.

As shown in FIG. 4, the engaging lock portion 17 provided at the connector housing 10 includes the lock arm 17 and a bending space 17*h*. Further, the protection portions 12*p* provided at the connector housing 10 are formed to include the pair of protection side walls 12*q* positioned at both sides of the lock arm 17 around the lock arm 17, respectively.

As shown in the drawings, the pair of the protection side walls 12*q* are positioned at the inside of the connector housing 10 so as to have a space with respect to the end edge portion 12*h* of the peripheral wall 12 forming the connector housing 10 in correspondence with the thickness of the peripheral wall 32 forming the rear cover 30.

The thin-thickness surface 32*f* (FIG. 6) of the peripheral wall 32 forming the rear cover 30 abuts against the end surfaces 12*r* (FIG. 4) of the protection side walls 12*q* provided at the connector housing 10 when an excessive power in an irregular direction is applied at the time of assembling the connector, whereby the excessive deformation of the lock arm 17 is prevented. The thin-thickness surface 32*f* of the peripheral wall 32 forming the rear cover 30 is contained within the inside surface 32*r* of the peripheral wall 32 forming the rear cover 30.

When the rear cover is configured in this manner, at the time of attaching the rear cover 30 to the connector housing 10, the peripheral wall 32 forming the rear cover 30 moves into the position between the peripheral wall 12 forming the connector housing 10 and the protection side walls 12*q* provided at the connector housing 10.

Since the thin-thickness surface 32*f* (FIG. 6) of the peripheral wall 32 forming the rear cover 30 abuts against the end surfaces 12*r* (FIG. 4) of the protection side walls 12*q* of the connector housing 10, the lock arm 17 provided as the engaging lock portion 17 of the connector housing 10 is protected by the protection side walls 12*q* provided at the both sides of the lock arm 17. Thus, the lock arm 17 can be prevented from being subjected to plastic deformation to a large extent.

As shown in FIG. 1, when the rear cover 30 is pressed against the connector housing 10 along the attachment direction S, the rear cover 30 is fitted into the connector housing 10, whereby the engagement portion 37 of the rear cover 30 is engaged and locked with the engaging lock portion 17 of the connector housing 10.

In this case, first, the slanted slide-contact surface 37*c* of the engagement projection 37 provided at the rear cover 30 shown in FIG. 6 is rubbed against the slanted slide-contact surface 17*c* of the engaging lock projection $\mathbf{17}_0$ provided at the connector housing 10 shown in FIG. 6.

Next, the slide-contact surface 37*b* of the engagement projection 37 provided at the rear cover 30 shown in FIG. 6 is rubbed against the slide-contact surface 17*b* of the engaging lock projection $\mathbf{17}_0$ provided at the connector housing 10 shown in FIG. 4. In this manner, the engagement projection 37 provided at the rear cover 30 shown in FIG. 6 moves over the engaging lock projection 170 provided at the connector housing 10 shown in FIG. 4.

In this case, the pair of the protection side walls 12*q* respectively forming the protection portions 12*p* are positioned at the inside of the connector housing 10 with a space corresponding to the thickness of the peripheral wall 32 (FIG. 7) forming the rear cover 30 with respect to the end edge portion 12*h* of the peripheral wall 12 forming the connector housing 10 as shown in FIG. 4. Thus, the rear cover 30 is attached to the connector housing 10 while the thin-thickness surface 32*f* (FIG. 6) of the peripheral wall 32 forming the rear cover 30 is slidably made in contact with the end surfaces 12*r* of the protection side walls 12*q* of the connector housing 10. The protection side walls 12*q* serve as guide walls for guiding the rear cover 30.

The engagement projection 37 provided at the rear cover 30 easily and surely moves over the engaging lock projection $\mathbf{17}_0$ (FIG. 4) provided at the lock arm 17 while bending the lock arm 17 provided at the connector housing 10 shown in FIGS. 3 and 4.

Thereafter, the engagement surface 37*a* of the engagement projection 37 provided at the rear cover 30 shown in FIG. 6 is abutted against the engaging lock surface 17*a* of the engaging lock projection $\mathbf{17}_0$ provided at the connector housing 10 shown in FIG. 4, whereby the rear cover 30 and the connector housing 10 are placed in a surely engaged and locked state. Further, when an operation reverse to that of the operation is performed, the engagement lock state between the rear cover 30 and the connector housing 10 is cancelled.

The engagement surface 37*a* is provided at the engagement portion 37 of the rear cover 30 as shown in FIGS. 1 and 6, and the engaging lock surface 17*a* is provided at the elastic lock arm 17 forming the engaging lock portion 17 of the connector housing 10 in correspondence to the engagement surface 37*a* as shown in FIGS. 1 and 4. The protection portions 12*p* provided at the connector housing 10 are formed to include the protection base walls 12*s* positioned at the bending direction of the elastic lock arm 17, respectively.

If the protection base walls 12*s* are provided so as to restrict the excessive deformation of the lock arm with respect to the bending direction of the elastic lock arm 17, such a problem can be prevented from occurring that when the rear cover 30 is fitted into and attached to the connector housing 10, the rear cover 30 or an electric wire is inadvertently urged against the elastic lock arm 17 and so the elastic lock arm 17 is largely bent to cause the plastic deformation at the lock arm 17.

Further, when a jig rod (not shown), for example, is used to sufficiently bend the elastic lock arm 17 (FIG. 4) toward the protection base walls 12*s* respectively forming the protection walls 12*p* the engagement lock state between the engaging lock surface 17*a* (FIGS. 1 and 4) of the elastic lock arm 17 provided at the connector housing 10 and the engagement surface 37*a* (FIGS. 1 and 6) provided at the engagement portion 37 of the rear cover 30 is canceled, whereby the rear cover 30 is placed in a state of being detachable from the connector housing 10 as shown in FIG. 1. In this case, as shown in FIG. 4, the tip end portion 17*e* of the elastic lock arm 17 abuts against the stop surfaces 12*t* of the protection base walls 12*s* whereby the excessive deformation of the elastic lock arm 17 due to the excessive displacement thereof can be restricted.

At the time of attaching the rear cover 30 to the connector housing 10 and also at the time of canceling the engagement lock state between the engaging lock portion 17 of the connector housing 10 and the engagement portion 37 of the rear cover 30 thereby to detach the rear cover 30 from the connector housing 10, since the elastic lock arm 17 serving as the engaging lock portion 17 abuts against the stop surfaces 12*t* of the protection base walls 12*s* serving as the protection portions 12*p* provided at the connector housing 10, the elastic lock arm 17 does not bend to an extent more than being required. Thus, the excessive deformation of the elastic lock arm 17 is prevented.

As shown in FIGS. 1 and 6, a plurality of oblong operation windows 37*h* for canceling the engagement lock state between the engaging lock portion 17 of the connector housing 10 and the engagement portion 37 of the rear cover 30 at the time of detaching the rear cover 30 from the connector housing 10 are provided at the peripheral wall 32 of the rear cover 30. A jig tool such as the jig rod is inserted into the operation window 37*h* provided at the peripheral wall 32 of the rear cover 30.

In the case of detaching the rear cover 30 from the connector housing 10, the jig rod (not shown) is inserted into the operation window 37*h* provided at the peripheral wall 32 of the rear cover 30. Then, as described above, the jig rod is suitably operated, whereby the engagement lock state between the engaging lock portion 17 of the connector housing 10 and the engagement portion 37 of the rear cover 30 can be cancelled easily and quickly.

The electric wire 60, attached with the female terminal 50 at its end portion as shown in FIG. 8, is used as each of four linear members 60 respectively to be introduced into the four terminal insertion portions 14*p* of the connector housing 10 shown in FIGS. 1 and 2.

The female terminal 50 to be attached to the connector housing 10 is attached to the end portion of the electric wire 60, then the electric wire 60 is extracted from the connector housing 10 (FIGS. 1 and 2), then the electric wire 60 is guided into the rear cover 30 and extracted to the desired direction. Thus, the plural electric wires 60 coupled to the connector are extracted to the desired direction.

Many small-sized other female terminals (not shown) are inserted into and attached within many opening portions 14*m* (FIG. 3) provided at the housing main body portion 14 of the connector housing 10. The not-shown other female terminals are attached to the end portions of many small-sized electric wires (not shown) together with small waterproof plugs (not shown), respectively. Holes 14*n* (FIGS. 3 and 5) provided at the center portion on the rear side of the housing main body portion 14 of the connector housing 10 come to the dead end within the housing main body portion 14.

The housing main body portion 14 is formed within the inner space 13*a* of the connector housing 10 so as to extend from the rear opening 13*d* (FIG. 3) side of the connector housing 10 to the front opening 13*b* (FIG. 5) side. A peripheral wall 14*c* (FIGS. 2 and 5) formed by a gentle curved surface and a plane portion is provided at the rear half portion 14*b* of the housing main body portion 14.

The waterproof packing 80 made of silicone rubber is fitted into the outer peripheral portion 14*d* of the peripheral wall 14*c* which is formed at the rear half portion 14*b* of the housing main body portion 14 of the connector housing 10 and configured by the gentle curved surface and the plane portion. The waterproof packing 80 is provided at its outer peripheral portion with three lip portions 82 and at its inner peripheral portion with an insertion portion 81 corresponding to the peripheral wall 14*c*.

The plural lip portions 82 provided at the outer peripheral portion of the waterproof packing 80 are adhered to the inner peripheral portion of the connector housing constituting the not-shown corresponding connector and so the plural lip portions 82 provided at the waterproof packing 80 are crushed, so that the portion between the plural lip portions and the inner peripheral portion of the connector housing is surely sealed.

Further, as shown in FIG. 8, the electric wire 60 is attached with pressure and coupled to the rear portion side of the female terminal 50 and the waterproof plug 70 made of silicon rubber is attached to the rear portion side of the female terminal 50 together with the electric wire 60.

The waterproof packing 80 and the female terminal 50 attached with the electric wire 60 and the waterproof plug 70 are attached within the connector housing 10, whereby the waterproof connector 1 with a cover is constituted as the connector 1 with a cover.

Since the waterproof connector 1 with a cover is constituted in a manner that both the waterproof packing 80 and the female terminal 50 attached with the electric wire 60 and the waterproof plug 70 are provided within the connector housing 10 of the connector 1 with a cover in this manner, the female terminal 50 provided at the connector 1 with a cover can be protected from water even when the connector 1 with a cover coupled to the corresponding connector (not shown) is exposed to water such as rain water or used within water. Thus, such problems can be prevented from occurring that electric contact failure occurs at the female terminal 50 and that short-circuit occurs through water.

A sealing member such as the waterproof plug 70 (FIG. 8) and the waterproof packing 80 (FIGS. 2 and 5) is configured to be provided with the plural lip portions 72, 82 capable of being urged against the sealing portion and crushed so that the sealing member is surely adhered to the sealing surface of a corresponding member corresponding thereto thereby to prevent water from entering within the connector. The waterproof plug 70 or the waterproof packing 80 is an almost cylindrical-shaped rubber elastic member. The waterproof plug 70 or the waterproof packing 80 is provided at both the inner peripheral portion and the outer peripheral portion with squeezes. When the squeezes are crushed, a suitable tension force is generated at the sealing member, whereby a subject member is sealed well.

The sealing member such as the waterproof plug 70 or the waterproof packing 80 is molded by using material with latent restorable elasticity represented by rubber material such as silicon rubber, nitrile rubber etc. or elastomer material, for example. Since such material is used for the sealing member, the sealing member capable of performing the sealing surely can be formed.

The linear member such as the electric wire 60 attached at its end portion with the waterproof plug 70 and the female terminal 50 is inserted into and attached to the connector housing 10 shown in FIGS. 1 and 2, and then the lever 40 is operated along the rotation direction R (FIG. 1), whereby the engagement portion 49 of the lever 40 is engaged and locked with the engaging lock portion 39 of the rear cover 30.

In this case, first, the slanted slide-contact surface 49*c* of the engagement projection 49 provided at the rotation lever 40 shown in FIG. 3 rubs against the slanted slide-contact surface 39*c* of the engaging lock projection $\mathbf{39}_0$ provided at the rear cover 30 shown in FIG. 6.

Next, the slide-contact surface 49*b* of the engagement projection 49 provided at the rotation lever 40 shown in FIG. 3 rubs against the slide-contact surface 39*b* of the engaging lock projection $\mathbf{39}_0$ provided at the rear cover 30 shown in FIG. 6. In this manner, the engagement projection 49 provided at the inside of the rotation lever 40 shown in FIG. 3 moves over the engaging lock projection $\mathbf{39}_0$ provided at the lock arm 39 while bending the lock arm 39 provided at the rear cover 30 shown in FIG. 6.

Thereafter, the engagement surface 49*a* of the engagement projection 49 provided at the rotation lever 40 shown in FIG. 3 abuts against the engaging lock surface 39*a* of the engaging lock projection $\mathbf{39}_0$ provided at the rear cover 30 shown in FIG. 6, whereby the rotation lever 40 is surely engaged and locked with the rear cover 30. Further, when an operation reverse to that of the operation is performed, the engagement lock state between the rear cover 30 and the rotation lever 40 is cancelled.

As shown in FIGS. 1 to 7, each of the connector housing 10, the front holder 20, the rear cover 30 and the rotation lever 40 has a complicated configuration. In order to manufacture the connector housing 10, the front holder 20, the rear cover 30 and the rotation lever 40 efficiently despite that each of the connector housing 10, the front holder 20, the rear cover 30 and the rotation lever 40 has such a complicated configuration, each of the connector housing 10, the front holder 20, the rear cover 30 and the rotation lever 40 is preferably molded by using material suitable for mass-production.

The connector housing 10, the front holder 20, the rear cover 30 and the rotation lever 40 are attached and detached to each other by utilizing the elastic property of the main body portions thereof or the elastic property of the engaging stop portion or the engaging portion provided each of them, so that each of the connector housing 10, the front holder 20, the rear cover 30 and the rotation lever 40 is preferably formed by composite resin with elastic property.

Thus, each of the connector housing 10, the front holder 20, the rear cover 30 and the rotation lever 40 is preferably formed by composite resin capable of injection molding, having thermoplastic property and having elastic property. As such composite resin capable of injection molding, having thermoplastic property and having elastic property, there is polybutyrene terephthalate resin (abbreviated as PBT) etc. Various kinds of filler such as reinforced fiber such as carbon fiber may be added to the composite resin as the need arises.

Each of the connector housing 10, the front holder 20, the rear cover 30 and the rotation lever 40 used in the example of the embodiment of the invention is formed by polybutyrene terephthalate resin (PBT) and so excellent in the stability of sizes, the stability of intensity and the insulation property etc. PBT-H01 etc. may be raised as polybutyrene terephthalate resin (PBT).

Although the connector with a cover according to the invention has been explained as to the low-insertion force connector with a cover provided with the waterproof function as an example, the invention may be applied to a non-waterproof connector as the connector with a cover or a connector with another configuration other than the low-insertion force connector. The connector with a cover according to the invention can be developed to any type of connector with a cover.

What is claimed is:

1. A connector, comprising:

a housing, in which a linear member is disposed;

a cover, attachable to the housing for guiding the liner member, and a correction portion, provided on the housing, wherein the correction portion corrects a deformation of the cover when the cover is engaged with the housing while the cover is deformed with respect to an original shape; and wherein the housing has a peripheral wall which extends toward the cover so that an opening of the housing is formed by an end portion of the peripheral wall; and wherein the correction portion extends in parallel with the peripheral wall and ends in substantially the same plane as the opening of the housing.

2. The connector as set forth in claim 1, wherein the correction portion includes a part of the peripheral wall which forms the housing and a reinforcing wall which is provided on the housing so as to form a space between the part of the peripheral wall and the reinforcing wall; and wherein a peripheral wall which forms the cover is inserted into the space so that the deformation of the cover is corrected when the cover is engaged with the housing.

3. The connector as set forth in claim 2, wherein the housing is a transversely elongated housing;

wherein the reinforcing wall is a plurality of reinforcing walls, each of the reinforcing wall is provided on an inner side of the peripheral wall of the housing; and wherein each of the reinforcing wall is extended in the transversely elongated direction of the housing.

4. The connector as set forth in claim 2, wherein the peripheral wall which forms the housing has a slanted guide face for guiding the peripheral wall of the cover into the space.

5. The connector as set forth in claim 2, wherein a peripheral wall which forms the cover has a slanted guide face for guiding the peripheral wall of the cover into the space.

6. The connector as set forth in claim 2, wherein the reinforcing wall has a slanted guide face for guiding the peripheral wall of the cover into the space.

7. The connector as set forth in claim 1, wherein the correction portion is connected to the peripheral wall of the housing by a partition wall; and wherein the partition wall is located at the vicinity of the opening of the housing.

* * * * *